US012529522B2

(12) United States Patent
Whalley

(10) Patent No.: US 12,529,522 B2
(45) Date of Patent: Jan. 20, 2026

(54) HEAT EXCHANGER CONSTRUCTION

(71) Applicant: HS Marston Aerospace Limited, Wolverhampton (GB)

(72) Inventor: Stephen Whalley, Telford (GB)

(73) Assignee: HS MARSTON AEROSPACE LIMITED, Wolverhampton (GB)

( * ) Notice: Subject to any disclaimer, the term of this patent is extended or adjusted under 35 U.S.C. 154(b) by 235 days.

(21) Appl. No.: 18/156,769

(22) Filed: Jan. 19, 2023

(65) Prior Publication Data

US 2023/0235967 A1 Jul. 27, 2023

(30) Foreign Application Priority Data

Jan. 21, 2022 (EP) ..... 22275009

(51) Int. Cl.

| | |
|---|---|
| ***F28D 9/00*** | (2006.01) |
| ***F28D 9/02*** | (2006.01) |
| ***F28F 3/00*** | (2006.01) |
| ***F28F 3/08*** | (2006.01) |

(52) U.S. Cl.

CPC ..... *F28D 9/0062* (2013.01); *F28F 2220/00* (2013.01); *F28F 2230/00* (2013.01); *F28F 2275/04* (2013.01)

(58) Field of Classification Search

CPC ..... F28D 9/02; F28D 9/0037; F28F 3/005; F28F 3/08; F28F 3/083; F28F 2220/00; F28F 2230/00; F28F 2275/04

USPC ..... 165/165, 166

See application file for complete search history.

(56) References Cited

U.S. PATENT DOCUMENTS 2,997,280 A * 8/1961 Keast ..... F28D 9/00 165/157
4,301,863 A 11/1981 Bizzarro
5,183,106 A 2/1993 Stancliffe et al.
6,520,252 B1 2/2003 Bizzarro
(Continued)

FOREIGN PATENT DOCUMENTS

DE 2450739 A1 4/1976
GB 838466 A 6/1960

OTHER PUBLICATIONS

Abstract for DE2450739 (A1), Published: Apr. 29, 1976, 1 page.
European Search Report for Application No. 22275009.3, mailed Aug. 9, 2022, 8 pages.

*Primary Examiner* — Frantz F Jules
*Assistant Examiner* — Jason N Thompson
(74) *Attorney, Agent, or Firm* — CANTOR COLBURN LLP

(57) ABSTRACT

A closure bar for a plate-fin heat exchanger core, the closure bar having a substantially rectangular main body portion defined by a first edge and a second edge and an end portion having a first end portion edge, and opposite second end portion edge and an end edge extending between the first end portion edge and the second end portion edge, wherein the first edge of the main body portion and the first end portion edge form a continuous substantially straight first closure bar edge and wherein the second end portion edge is spaced from the first end portion edge by a distance (d1) greater than the distance (d2) between the first edge and second edges of the main body portion, and wherein the second edge of the main body portion and the second end portion edge joined by a radius portion define a second edge of the closure bar.

13 Claims, 6 Drawing Sheets

(56) References Cited

U.S. PATENT DOCUMENTS

| | | | | |
|---|---|---|---|---|
| 2009/0032232 | A1* | 2/2009 | Murayama | F28D 9/0037 29/890.03 |
| 2013/0277028 | A1* | 10/2013 | Heinio | F28D 9/0062 29/890.03 |
| 2016/0116233 | A1* | 4/2016 | Shao | F28D 9/0062 165/166 |
| 2018/0266774 | A1* | 9/2018 | Guo | F28D 9/0068 |
| 2020/0108474 | A1* | 4/2020 | Thresher | B23P 15/26 |
| 2021/0048257 | A1* | 2/2021 | Barriga | F28F 3/005 |

* cited by examiner

HEAT EXCHANGER CONSTRUCTION

CROSS-REFERENCE TO RELATED APPLICATIONS

This application claims priority to European Patent Application No. 22275009.3 filed Jan. 21, 2022, the entire contents of which is incorporated herein by reference.

TECHNICAL FIELD

The present disclosure relates to heat exchangers, and particularly designs of plate-fin type heat exchanger cores.

BACKGROUND

Plate-fin heat exchangers are well known in the art to provide fluid flow passages for heat transfer between fluids. Typically, such heat exchangers include a core comprising stacked layers of corrugated fin elements separated by plate elements, also known as parting sheets. The layers of fin elements are stacked such that alternate layers, for fluid flow of the first of a hot or cold fluid, provide channels or flow paths in a first direction and a layer is provided between each of these alternate layers to provide fluid flow of the other of the hot or cold fluid in a second direction which is either parallel and opposite to, or transverse to the first direction. The stack of sheets is provided with a structurally strong top sheet and bottom sheet, and solid closure bars are provided on alternate layers at the core sides to provide a seal and direct the fluid flow through the channels. The closure bars of a conventional core design are rectangular bars that cross over at the corners of the stack defining an L-shaped corner recess at each corner. Solid corner angles are provided (e.g. brazed) at the corners of the block, in the recess, from the top sheet to the bottom sheet to provide a complete block unit that can be attached to the header parts of the heat exchanger from which the fluids are provided. The corner bars seal the layers and separate the two fluid flows, give structure to the core and may be used to provide a surface to which the header parts can be secured e.g. by welding.

Although the heat exchanger core is typically provided as a substantially rectangular block, hot air provided to the core via the header inlet port is generally provided via a narrow, usually circular cross-section inlet port, in a relatively narrow flow which impacts the core in a fairly concentrated, substantially circular, area around the centre of the fluid entry side of the core block. This results in a localised heating resulting in uneven thermal expansion in the core in some conditions. This occurs, for example, in aircraft heat exchangers during transient flight conditions.

Because the top and bottom sheets are relatively cool and also relatively heavy and solid, and so relatively resistant to bending, the concentrated heating and the uneven thermal expansion of the core elements e.g. the closure bars in the centre of the core, causes a bending distortion of the corner angles, forcing them to bend outwards. This bending load, particularly when varying due to cyclic thermal changes, causes fatigue in the corner angles and can result in cracks which propagate through the corner angles.

Because of this problem, heat exchanger cores may have to be replaced much sooner that the normal life of the heat exchanger parts. In a typical civil aircraft, for example, buffer air coolers typically require replacement or a new core at around 50% of engine service life.

There is therefore a need for a heat exchanger core design that is less susceptible to damage resulting from uneven thermal stresses at the centre of the core.

SUMMARY

According to a first aspect, there is provided a closure bar for a plate-fin heat exchanger core, the closure bar having a substantially rectangular main body portion defined by a first edge and a second edge and an end portion having a first end portion edge, and opposite second end portion edge and an end edge extending between the first end portion edge and the second end portion edge, wherein the first edge of the main body portion and the first end portion edge form a continuous substantially straight first closure bar edge and wherein the second end portion edge is spaced from the first end portion edge by a distance greater than the distance between the first edge and the second edge of the main body portion, and wherein the second edge of the main body portion and the second end portion edge joined by a radius portion define a second edge of the closure bar.

Also provided is a plate-fin heat exchanger core comprising: a plurality of fin layers arranged in a stack, each fin layer defining a fluid flow channel, the fin layers comprising first alternating fin layers defining a fluid flow channel in a first direction and second alternating fin layers arranged to alternate with the first fin layers in the stack, defining a fluid flow channel in a second, different direction, and a plurality of closure bars as claimed in claim 1 including a first plurality of closure bars arranged to seal the first alternating fin layers on a first side of the stack and a second plurality of closure bars arranged to seal the second plurality of fin layers on a second side of the stack adjacent the first, wherein the first closure bars are arranged such that their end portions overlap and their end edges align, and the second closure bars are arranged such that their end portions overlap and their end edges align, and wherein the end portions of the first and second closure bars overlap to define a solid corner of the stack, and wherein the first closure bars are stacked in an order such that topmost and bottommost closure bars have a second end portion edge of a first length and the length of the other first closure bars in the stack decrease with respect to the first length towards the middle of the stack to form a curved inner end portion profile from top to bottom of the stack.

A heat exchanger, and methods of making are also provided.

BRIEF DESCRIPTION OF THE DRAWINGS

Examples of the heat exchanger core design according to the disclosure will be described by way of example only with reference to the drawings. It should be noted that variations are possible within the scope of the claims.

DETAILED DESCRIPTION

Figure 1:
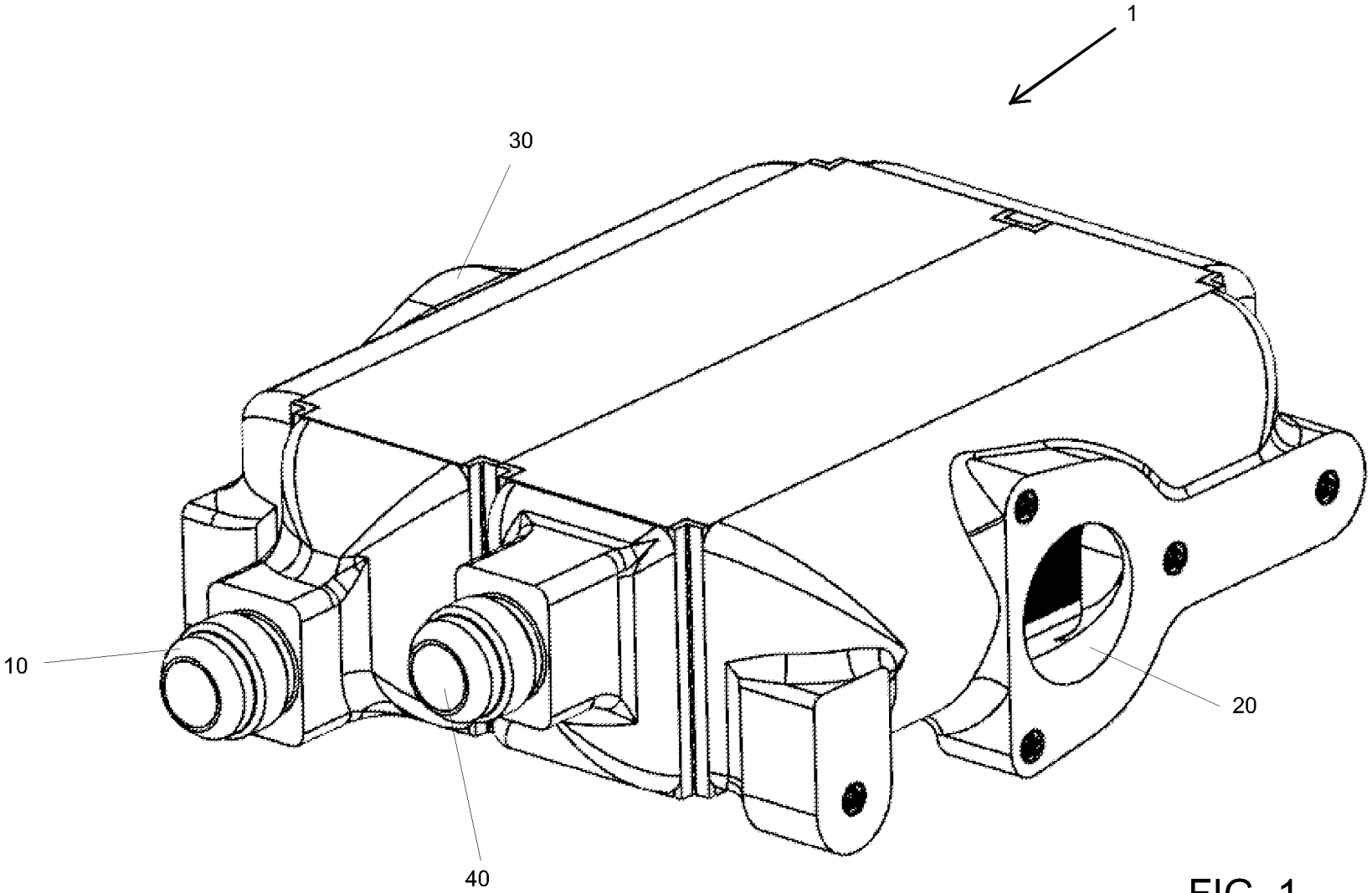
FIG. 1 is a perspective view of a typical heat exchanger.

A typical heat exchanger will first be described, by way of background, with reference to FIGS. 1 to 3. The design and operation of such heat exchangers is well known and so will only be described briefly.

A typical heat exchanger of the plate-fin type has a housing 1 within which the heat exchanger core (described further below) is arranged. The housing includes headers having an inlet 10 for a first (warm or hot) fluid and an inlet 20 for a second (cold) fluid as well as one or more warm fluid outlets 30, 40. In one example, the first and second fluids are warm and cold air, but other fluids are also possible. A heat exchanger core (as described in the background above and as will be described further below) is located inside the housing, fluidly connecting the inlet and outlet ports such that the first fluid flows through channels in a first direction (here from inlet 10) and the second fluid flows through the alternate channels (here from inlet 20) which are arranged either in a parallel and opposite direction or in a transverse direction. Heat is exchanged between the two fluids in the heat exchanger core such that resulting warm fluid exits via an outlet (30 or 40).

Figure 2:
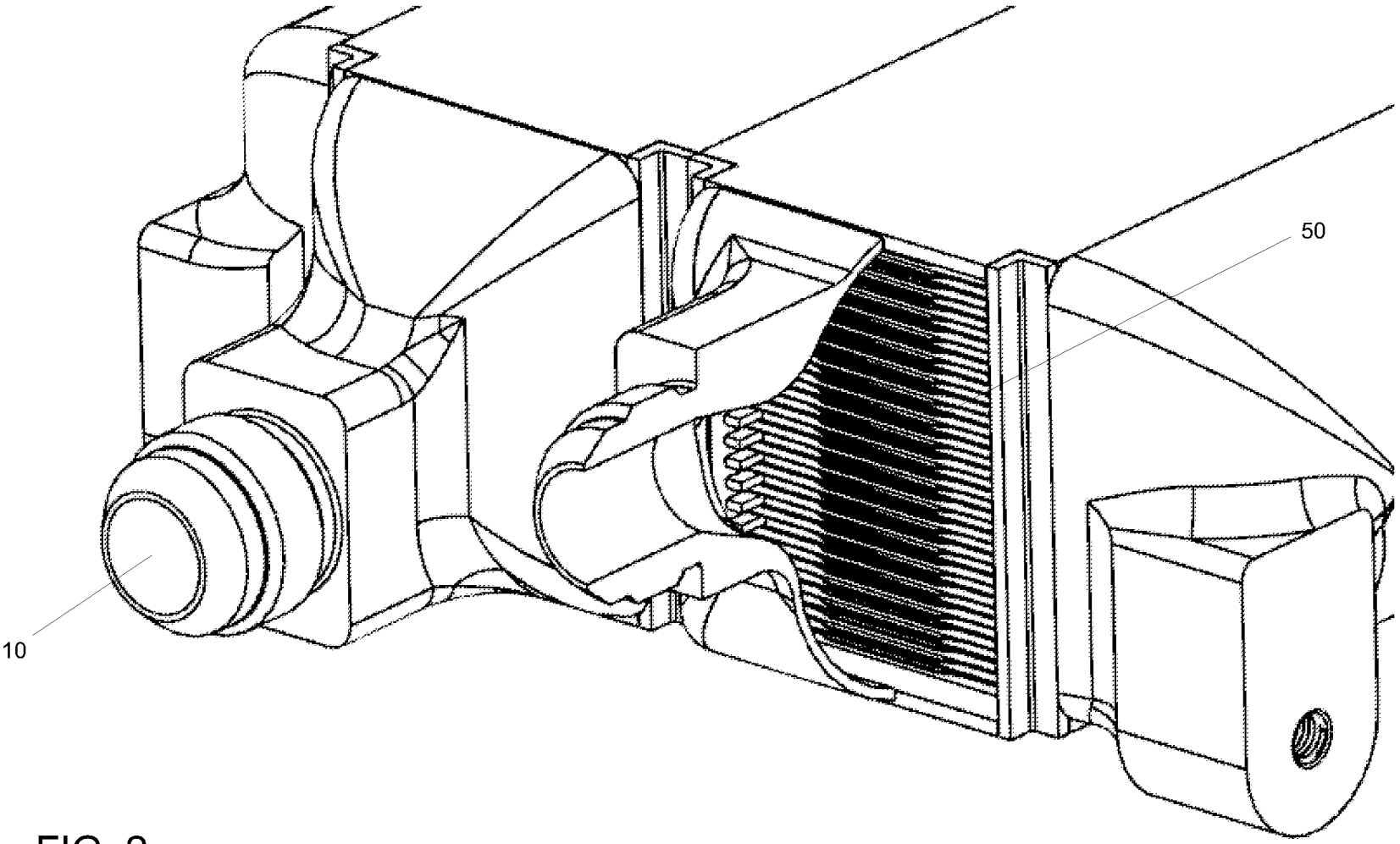
FIG. 2 is a partially exposed view of the header part of the heat exchanger of FIG. 1.
Figure 3:
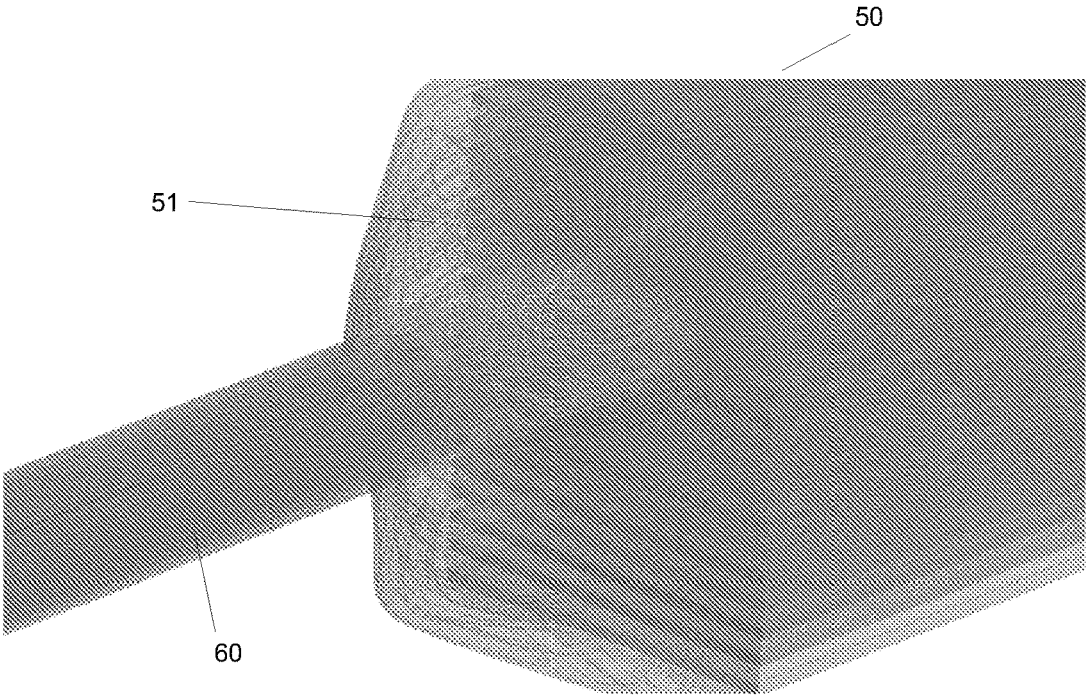
FIG. 3 shows how incoming hot or warm air typically impacts the heat exchanger core.
Figure 4:
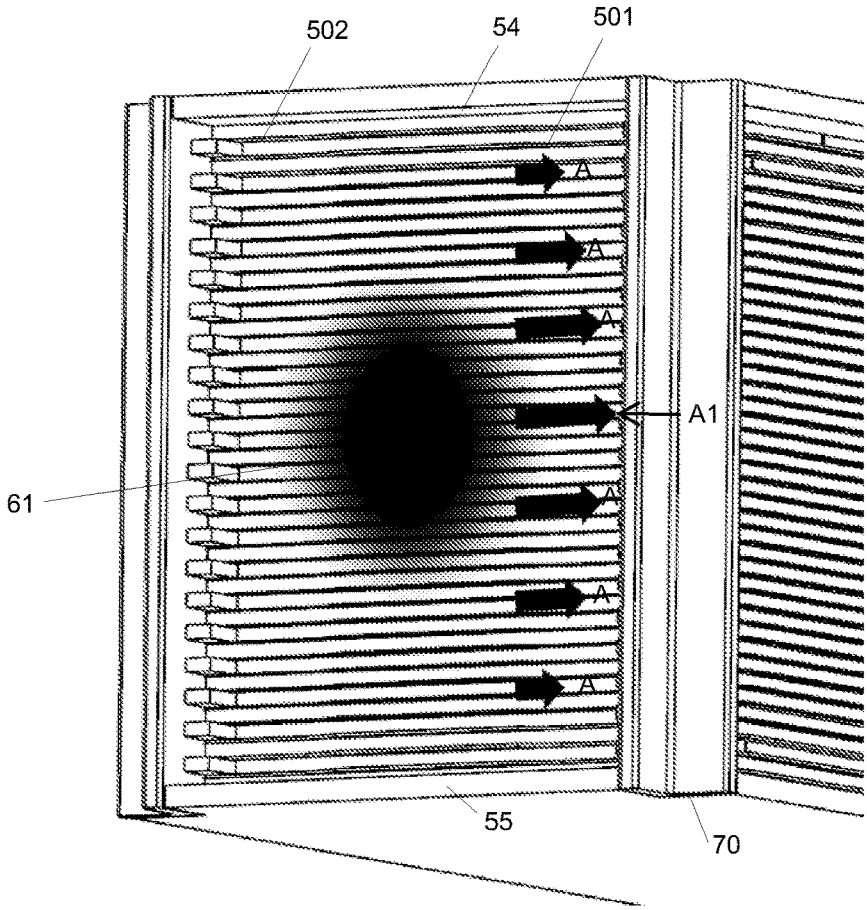
FIG. 4 shows the thermal forces in a typical heat changer.
Figure 5:
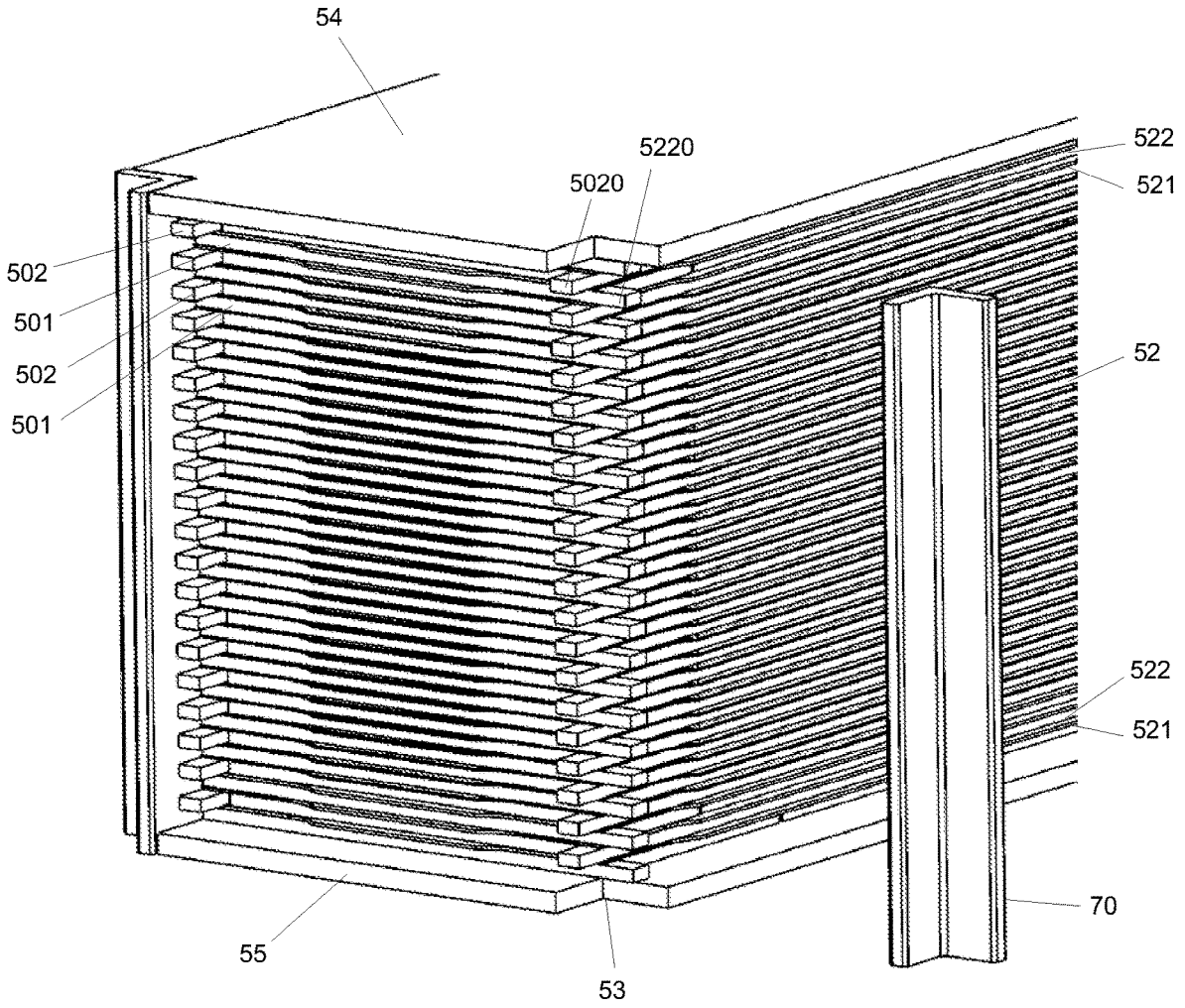
FIG. 5 shows a closure bars and corners of a typical heat exchanger core.

As can be seen in FIG. 2, the heat exchanger core 50 is arranged such that a side is in fluid communication with each of the inlets and outlets. The inlets and outlets are typically cylindrical, usually circular cylindrical ports. FIG. 3 shows how, typically, the warm or hot fluid provided to the heat exchanger via the first fluid inlet 10 is directed in a circular cylindrical stream 60 and impacts the side 51 of the heat exchanger core in a relatively concentrated central area, where it passes through the channels. This can be more clearly seen in FIG. 4 whish shows an example of a typical heat exchanger core 50. As described in the background, such cores include layers of corrugated fins arranged to define alternating flow channels for the two different fluids—either parallel and opposite channels or transverse—i.e. cross-flow—channels. On each side of the core, the layers 501 of fins defining the channels for flow of the fluid entering or exiting that side are open to receive/exit the fluid and the alternate layers are closed by closure bars 502. For a cross-flow arrangement, then, with reference to FIGS. 4 and 5, on a first side 51, which, for example, is in fluid connection with the hot fluid inlet 10, every other layer 501 is open to receive the hot fluid and the intermediate layers are closed by closure bars 502. On a second side 52, transverse to the first side in this example (in parallel flow arrangements, this would be an opposite side), the layers that were open on the first side are closed by closure bars 522 on the second side and the intermediate layers 521 (which were closed on the first side) are open to receive the cold fluid from the second fluid inlet 20. The rectangular closure bars 502, 522 overlap at their ends 5020, 5220 as best shown in FIG. 5 to define a corner recess 53 at each corner of the core block 50.

A solid top sheet 54 and bottom sheet 55 are located, respectively, over the top and bottom of the stacked layers. To seal the block and direct the two different fluid flows, an L-shaped corner angle 70 is fitted into the recess 53 defined by the closure bar ends and is secured to the bars and the top and bottom sheets e.g. by brazing.

Referring again to FIGS. 3 and 4, the concentrated flow 60 of hot fluid impacting the side 51 of the core forms a central region 61 on the core side 51 that is hotter than the remainder of the side, which results in uneven thermal expansion. This is indicated by arrows A in FIG. 4 where there is greater thermal expansion A1 around the middle layers than at the outer layers. The corner angles 70 are retained at the top and bottom by the relatively colder, heavy top and bottom sheets, but the increased thermal expansion around the middle of the core (A1) acts on the corner angle 70 forcing it to bend outwards (as shown by the dashed line in FIG. 4). The different thermal expansion across the core results in high stresses and thermal fatigue on the components, particularly the corner angles 70.

Figure 7:
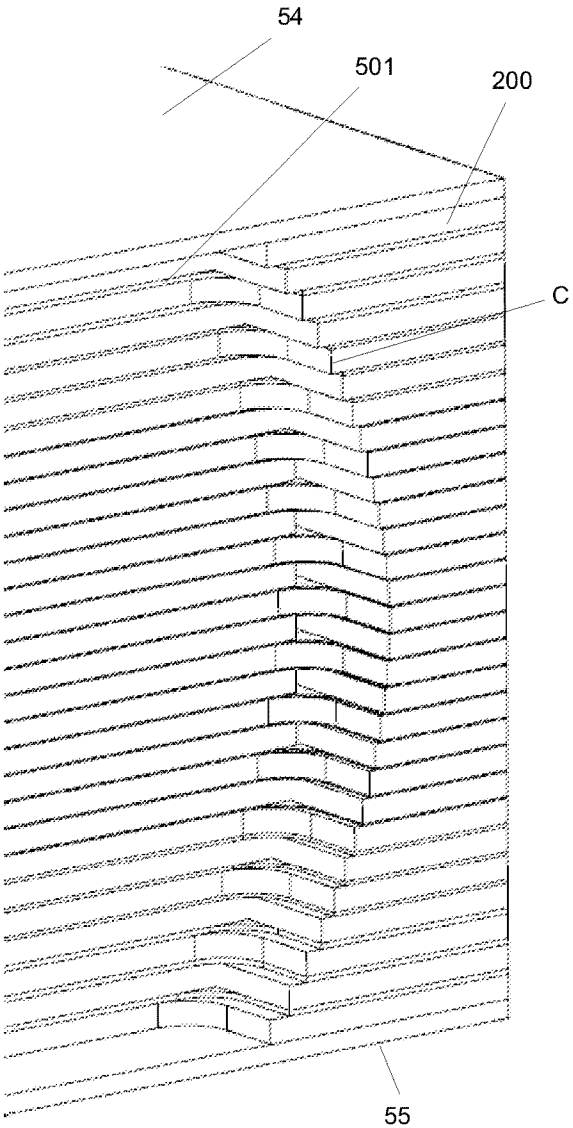
FIG. 7 shows a corner section of a heat exchanger core according to the disclosure.
Figure 6:
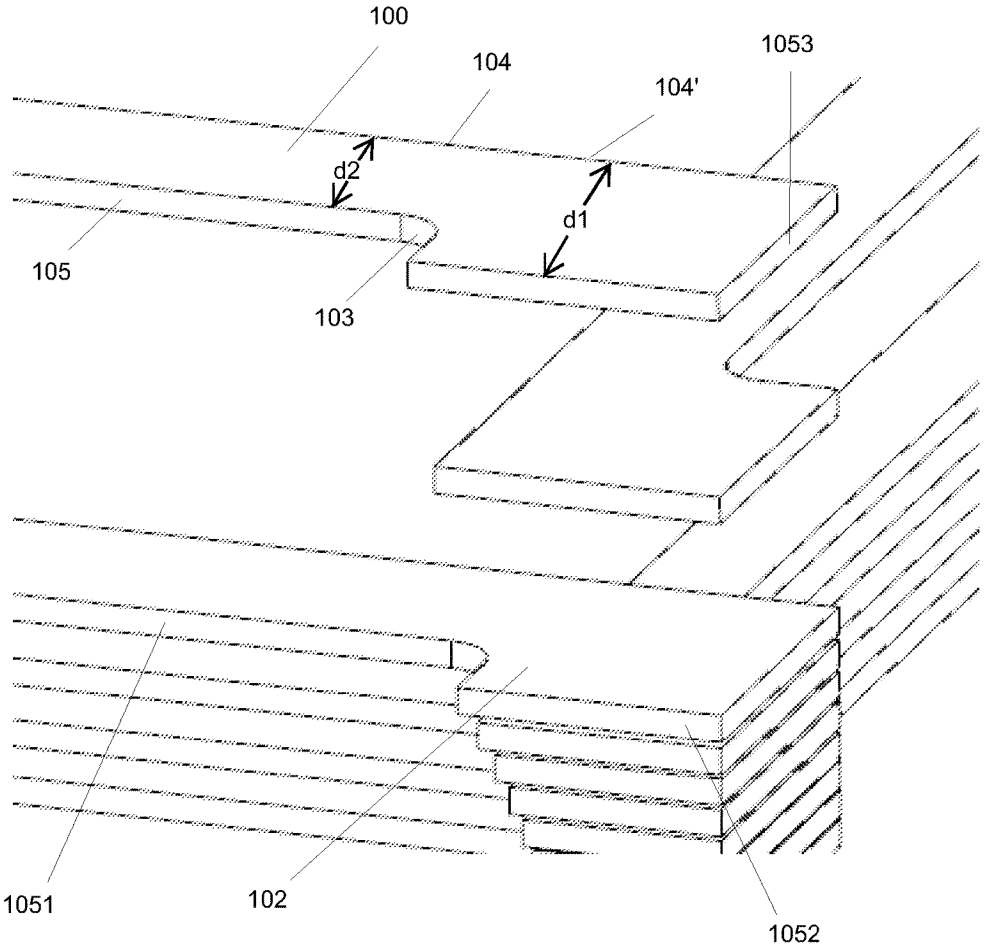
FIG. 6 shows an example of closure bars for use in a heat exchanger core according to the disclosure.
Figure 8:
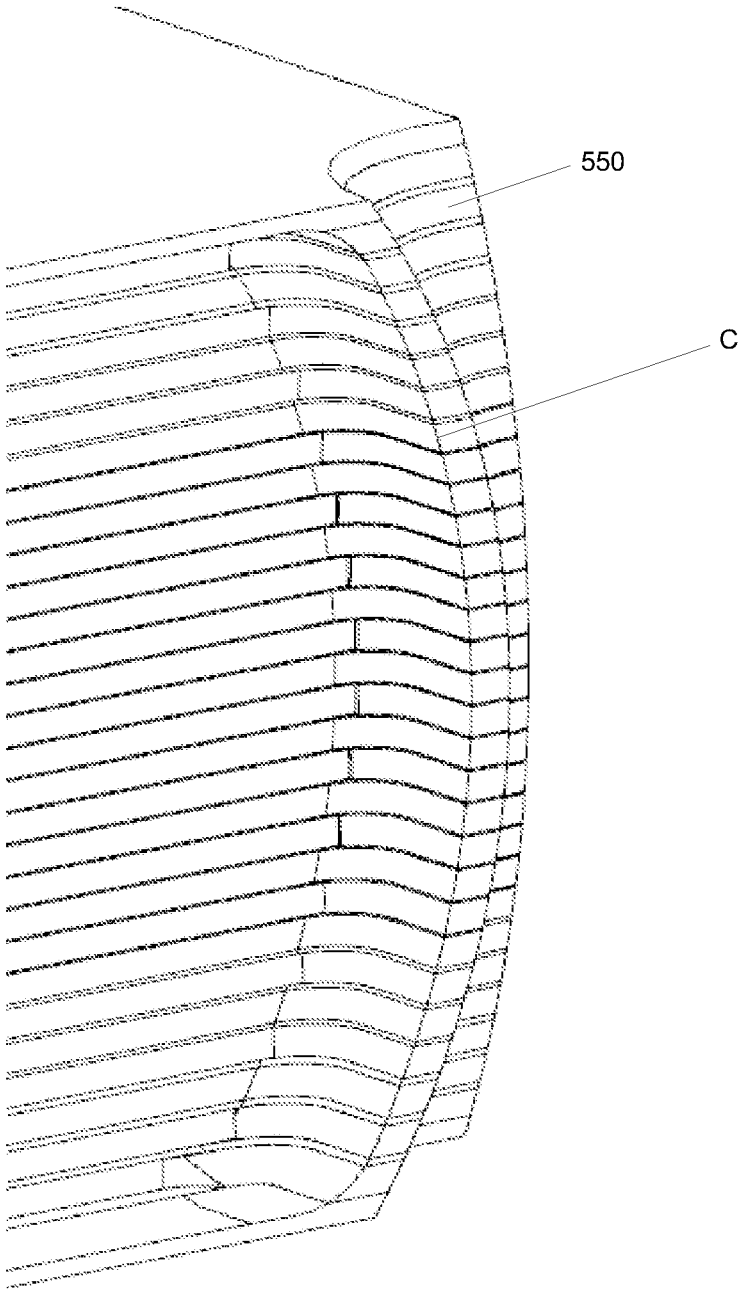
FIG. 8 shows a further example of a heat exchanger core according to the disclosure.

The core design of this disclosure addresses this problem as will be described further below with reference to FIGS. 6 to 8.

The core is of a plate-fin type essentially as described above in that it comprises a stack of layers of fins each layer providing flow channels, the channels arranged to alternate from top to bottom between a first and a second flow direction—the second flow direction being either parallel and opposite, or transverse to the first direction. Closure bars are provided to seal alternate layers where flow is to be prevented through those layers. A top sheet and a bottom sheet are provided, respectively, on the top and bottom of the stack of layers.

The core will be arranged to be provided in a heat exchanger housing having inlets and outlets as described above. The housing may be as shown in FIGS. 1 and 2, but other housing structures could also be used and the disclosure is not limited in this respect. For high temperature applications, housings are typically made of steel, but other materials may be used. The fluids, as with the known heat exchangers described above, may be hot and cold air but can also be other heat exchange fluids.

The design of this disclosure, however, modifies the closure bars as described below, with reference to FIGS. 6 to 8, to take into account the uneven thermal expansion due to the hot fluid stream 60 being concentrated mostly around the middle of the heat exchange core side on which it is incident.

According to the disclosure, rather than being straight rectangular bars as in the prior art, the closure bars 100 are profiled such that they have a substantially rectangular main body portion 101 that extends along the layer of fins to be closed and a wider end portion 102 that has a width greater than the main body portion 101. A radius 103 defines the transition between the main body portion 101 and the end portion 102. The first edge 104 of the closure bar that is sealingly located with the fin layer to be closed is a continuous substantially straight edge extending along the main body portion and the end portion. The opposite edge 105 of the closure bar includes a main body portion edge 1051 being a first distance from the first edge 104, an end portion edge 1052 being a second, greater distance from the first edge 104, and the radius 103 between the main body portion edge and the end portion edge. The end portions also have an end edge 1053 joining the end portion edge to the first edge, at each end of the closure bar. The length of the end portion edge 1052 varies from closure bar to closure bar in the stack as shown in FIG. 7. The core is formed by stacking fins layers 501 as is conventional. On each side of the resulting stack, closure bars 100 are provided on alternative layers to seal the layers to that side. The profiled closure bars 100 are stacked such that the closure bars adjacent the top plate 54 and the bottom plate 55 (i.e. the top-most and bottom-most closure bars) have the longest end portion edge 1052 and that the length of the end portion edge of the other closure bars decreases towards the middle of the stack, thus forming a substantially curved end portion profile between the top and bottom plates, with the end edges of the closure bars aligned as shown in FIG. 7. A corresponding structure of closure bars is formed on the adjacent side of the block (but sealing the other alternate layers). The closure bars on the two adjacent sides are stacked such that the end portions of the bars on one side overlap with the end portions of the closure bars on the other side, as shown in FIG. 6. The end edges of the closure bars on one side all align with each other and also align with the end portion edges of the closure bars of the other side thus forming a solid corner section of the block between the top and bottom sheets as best seen in FIG. 7.

According to one embodiment, a closure bar for a plate-fin heat exchanger core is disclosed. The closure bar has a substantially rectangular main body portion (101) defined by a first edge (104) and a second edge (1051) and an end portion (102) having a first end portion edge (104'), and opposite second end portion edge (1052) and an end edge (1053) extending between the first end portion edge and the second end portion edge, wherein the first edge of the main body portion and the first end portion edge form a continuous substantially straight first closure bar edge and wherein the second end portion edge is spaced from the first end portion edge by a distance (d1) greater than a distance (d2) between the first edge and the second edge of the main body portion, and wherein the second edge of the main body portion and the second end portion edge joined by a radius portion define a second edge of the closure bar.

According to another embodiment, a plate-fin heat exchanger core is disclose. The core includes: a plurality of fin layers (501) arranged in a stack, each fin layer defining a fluid flow channel, the fin layers comprising first alternating fin layers defining a fluid flow channel in a first direction and second alternating fin layers arranged to alternate with the first fin layers in the stack, defining a fluid flow channel in a second, different direction, and a plurality of closure bars (502). The closure bards include a first plurality of closure bars arranged to seal the first alternating fin layers on a first side of the stack and a second plurality of closure bars arranged to seal the second plurality of fin layers on a second side of the stack adjacent the first, wherein the first closure bars are arranged such that their end portions (102) overlap and their end edges align, and the second closure bars are arranged such that their end portions overlap and their end edges align, and wherein the end portions of the first and second closure bars overlap to define a solid corner (200) of the stack, and wherein the first closure bars are stacked in an order such that topmost and bottommost closure bars have a second end portion edge of a first length and the length of the other first closure bars in the stack decrease with respect to the first length towards the middle of the stack to form a curved inner end portion profile (C) from top to bottom of the stack.

The profile bars may be formed using laser cutting or water jet cutting for speed and precision, but other ways of shaping the bars may also be used.

The inner curved profile, C, resulting from the stacking of the profiled closure bars provides a structure that more closely matches the thermal expansion pattern described above and therefore reduces thermal loading on the structure. Furthermore, because the end portions of the closure bars all overlap to form a solid structure, there is no need for additional corner angles to be brazed to the structure and so the problem of the corner angles being damaged due to thermal stresses does not arise. Furthermore, the structure removes the need for an additional brazing step that is conventionally needed to attach the corner angles and avoids one potential leak site. The header parts of the heat exchanger can be attached to this structure e.g. by welding.

In a further example, the solid corner provided by the overlapping end portions can be shaped e.g. using a CNC machine to machine away the extra end portion material to form an outer profile 550 at the corners. This profile can be configured to allow for improved stress distribution and provides edges to which the header parts can be more easily attached. Machining away the redundant material from the corners also results in an overall weight reduction of the core without any loss of performance.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. A plate-fin heat exchanger core comprising:

a plurality of fin layers arranged in a stack, each fin layer defining a fluid flow channel, the fin layers comprising first alternating fin layers defining a fluid flow channel in a first direction and second alternating fin layers arranged to alternate with the first fin layers in the stack, defining a fluid flow channel in a second, different direction; and a plurality of closure bars each closure bar including:

a substantially rectangular main body portion defined by a first edge and a second edge; and an end portion having a first end portion edge, an opposite second end portion edge and an end edge extending between the first end portion edge and the second end portion edge, wherein the first edge of the main body portion and the first end portion edge form a continuous substantially straight first closure bar edge;

wherein the second end portion edge is spaced from the first end portion edge by a distance (d1) greater than a distance (d2) between the first edge and the second edge of the main body portion;

wherein the second edge of the main body portion and the second end portion edge joined by a radius portion define a second edge of the closure bar;

wherein the plurality closure bars include a first plurality of closure bars arranged to seal the first alternating fin layers on a first side of the stack and a second plurality of closure bars arranged to seal the second plurality of fin layers on a second side of the stack adjacent the first, wherein the first closure bars are arranged such that their end portions overlap and their end edges align, and the second closure bars are arranged such that their end portions overlap and their end edges align, and wherein the end portions of the first and second closure bars overlap to define a solid corner of the stack, and wherein the first closure bars are stacked in an order such that topmost and bottommost closure bars have a second end portion edge of a first length and the length of the other first closure bars in the stack decrease with respect to the first length towards the middle of the stack to form a curved inner end portion profile (C) from top to bottom of the stack.

2. A plate-fin heat exchanger core as claimed in claim 1, wherein the second closure bars are stacked in an order such that top-most and bottom-most closure bars have a second end portion edge of a first length and the length of the other first closure bars in the stack decrease with respect to the first length towards the middle of the stack to form a curved inner end portion profile from top to bottom of the stack on the second side.

3. A plate-fin heat exchanger as claimed in claim 1, further comprising a top plate across the top of the stack and a bottom plate across the bottom of the stack.

4. A plate-fin heat exchanger core as claimed in claim 3, wherein the top plate and the bottom plate are attached to the stack by brazing.

5. A plate-fin heat exchanger core as claimed in claim 4, wherein the solid corner of the stack is formed to have an outer curved profile between the top and bottom of the stack.

6. A plate-fin heat exchanger core as claimed in claim 1, wherein the second direction is parallel to and opposite the first direction.

7. A plate-fin heat exchanger core as claimed in claim 1, wherein the second direction is transverse to the first direction.

8. A heat exchanger comprising:

a first fluid input;

a second fluid input; and a first fluid output; and the plate-fin heat exchanger core as recited in claim 2 arranged in fluid communication with the first fluid input, the second fluid input and the fluid output, such that a first fluid provided through the first fluid input flows through the fluid channel in the first direction and a second fluid provided through the second input flows through the fluid flow channel in the second direction such that heat is exchanged between the first and second fluids and wherein one of the first or second fluids, after the heat exchange, exits the core via the first fluid output.

9. A heat exchanger as claimed in claim 8, further comprising a second fluid output, the first fluid output being in communication with the fluid channel in the first direction and the second fluid output being in communication with the fluid channel in the second direction.

10. A heat exchanger as claimed in claim 8, wherein the fluid inputs and output(s) are provided in a header unit mounted to the heat exchanger core stack.

11. A heat exchanger as claimed in claim 10, wherein the header unit is attached to the solid corner of the stack by welding or brazing.

12. A method of forming a plate-fin heat exchanger core as claimed in claim 1, further comprising:

stacking the closure bars in an order such that the inner curved profile is formed between the top and bottom of the stack.

13. The method of claim 12, further comprising:

shaping the outer profile of the solid corner to form a curved profile between the top and bottom of the stack.

* * * * *